US005511996A

United States Patent [19]

Levin

[11] Patent Number: 5,511,996

[45] Date of Patent: Apr. 30, 1996

[54] CONNECTOR CONTACT AND METHOD

[75] Inventor: Yuri Levin, Ft. Lauderdale, Fla.

[73] Assignee: A.W. Industries, Inc., Fort Lauderdale, Fla.

[21] Appl. No.: 339,021

[22] Filed: Nov. 14, 1994

[51] Int. Cl.[6] ..... H01R 4/48

[52] U.S. Cl. ..... 439/862; 439/188; 439/512; 439/513

[58] Field of Search ..... 439/188, 507, 439/512, 513, 751, 862

[56] References Cited

U.S. PATENT DOCUMENTS

| | | | |
|---|---|---|---|
| 3,812,445 | 5/1974 | Stefani | 439/223 |
| 4,071,290 | 1/1978 | DeNigris et al. | 438/888 |
| 4,327,954 | 5/1982 | Aldridge et al. | 439/498 |
| 4,834,661 | 5/1989 | McMillian | 439/636 |
| 4,966,557 | 10/1990 | Barkus et al. | 439/751 |
| 5,089,057 | 2/1992 | Plewes | 439/887 |
| 5,098,306 | 3/1992 | Noschese | 439/188 |
| 5,403,209 | 4/1995 | Lytle | 439/751 |

FOREIGN PATENT DOCUMENTS

| | | | |
|---|---|---|---|
| 0068656 | 1/1983 | European Pat. Off. | 439/751 |
| 0092150 | 10/1983 | European Pat. Off. | 439/751 |

*Primary Examiner*—P. Austin Bradley
*Assistant Examiner*—Jill DeMello
*Attorney, Agent, or Firm*—Jack E. Dominik

[57] ABSTRACT

Solving the problem of breakage of beryllium, copper contacts by applying heat shock to a condition just short of visible oxidation and then promptly water quenching is disclosed. After being so treated, the contacts are then processed in the traditional way which normally anticipates an acid rinse, and subsequent plating. The product of the process can be definitely identified by bending. If not annealed, it will break by bending more than 45°. If annealed properly in accordance with the process of the invention, it will withstand three or four bends to 90° before breakage. Where a compliance section exists in the contact, it is important that it be in the zone of applying the heat shock so that after the heat shock annealing process is concluded, the compliance section will behave like a softer material.

4 Claims, 3 Drawing Sheets

CONNECTOR CONTACT AND METHOD

FIELD OF THE INVENTION

The present invention is directed to the field of connectors in which a plurality of contacts are inserted, the connector being intended for subsequent connection to a mother board or other receiver for transmitting numerous signals by numerous contacts within the connector.

SUMMARY OF THE PRIOR ART

Connectors exemplary of the present invention are identified in U.S. Pat. Nos. 4,186,062; 4,401,522; 4,361,470; 4,064,019; and 3,732,529. Methods for applying plating to stamped parts are exemplified in U.S. Pat. Nos. 4,045;868; 4,156,553; 4,188,715; 4,220,393; 4,269,468; and 3,989,331.

Most of the subject connectors have a plurality of contacts, all of which are small metal stamped units having a contact head, and a tail to which additional wiring for signal or current transmission purposes are secured.

The subject contacts are normally made of beryllium copper when excellent spring properties are required. An adverse property of beryllium copper, however, is its brittleness when heat treated to have good spring qualities. Often times when a beryllium, copper contact is formed in strip lines, and they are press-fitted into the connector socket, breakage can occur at a point of movement restriction. When an operator wire wraps the tail of the contact, it can cause the contact to break at the point where movement is restricted by the connector mounting of the contact at what is known as the compliance section.

A further problem, arises because of the use of beryllium copper in forming the contact where a compliance section is in the contact between the spade and the tip of the tail. The compliance section is designed to press-fittingly engage a hole in a printed circuit board to form a gas-tight fitting. When beryllium copper is heat treated to have its best spring properties, it becomes hart and brittle and may damage the printed circuit board hole when inserted. Thus, there are two inherent problems with using beryllium copper, namely, breakage at the point of movement restriction, and brittleness of the compliance section which, in turn, will damage the interfit between the compliance section and a printed circuit board.

These problems are exacerbated because the manufacturer of the connector normally is not involved in the process of wire wrapping the tails of the connector. Damage can occur in connection with poor handling as well. This, the quality control which might be exercised by the connector manufacturer to insure care and caution in the connecting process, is not available.

SUMMARY OF THE INVENTION

The present invention has solved the problem of breakage of beryllium copper contacts by applying heat shock to a condition just short of visible oxidation and then promptly water quenching. After being so treated, the contacts are then processed in the traditional way which normally anticipates an acid rinse, and subsequent plating. The product of the process can be definitely identified by bending. If not annealed, it will break by bending more than 45°. If annealed properly in accordance with the process of the invention, it will withstand three or four bends to 90° before breakage. Where a compliance section exists in the contact, it is important that it be in the zone of applying the heat shock so that after the heat shock annealing process is concluded, the compliance section will behave like a softer material.

In view of the foregoing it is a principle object of the present invention to produce a contact for a connector which is formed of beryllium copper and heat treated in such a fashion as to reduce the tendency to break in an intermediate portion of the body during the wiring phase of the board assembly. Also a related object is to anneal the beryllium copper contact so that even when bad handling is involved, the tendency to break is minimized.

Also an important object of the present invention is to heat shock treat the contacts where they have a compliance section which will soften the compliance section so that it will not damage the P.C. board hole when inserted.

Another object of the present invention is to achieve an annealed contact by a single pass through a single production line in a reel-to-reel plating series which does not significantly increase the manufacturing cost, and conversely, is highly cost effective when compared with the costs of rejects which most assuredly will arise when the contacts are not annealed and they are subsequently processed for assembly into the connector and thereafter into the circuit for which the connector is intended.

Yet another object of the present invention is to provide a method for annealing a beryllium copper contact which does not require expensive tooling, and can be easily monitored for purposes of achieving uniformity and the consequent quality control of the product.

BRIEF DESCRIPTION OF THE ILLUSTRATIVE DRAWINGS

Further objects and advantages of the present invention will become apparent as the following description of an illustrative embodiment proceeds, taken in conjunction with the accompanying drawing, in which.

DESCRIPTION OF A PREFERRED EMBODIMENT

The Connector

Figure 1:
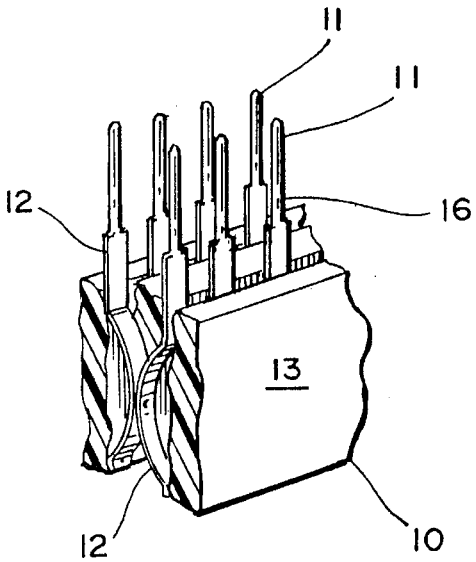
FIG.1 is a perspective cut-away view of an illustrative connector in which the annealed contacts of the present invention are employed.
Figure 2:
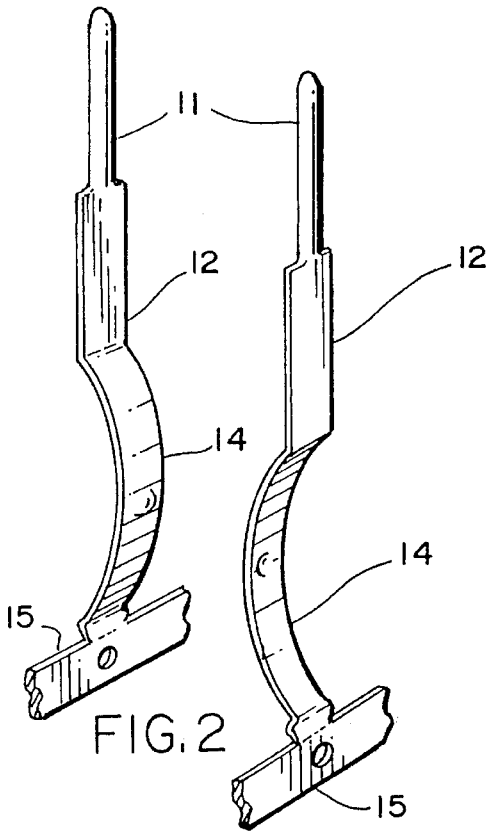
FIG. 2 is a perspective view of the subject connector showing the contact independent of the connector.

The connector 10 of the subject invention is best illustrated in FIG. 1 of the drawings where it will be seen that a plurality of contacts 11 are inserted into the insulator body 13 with the two end contacts being shorting contacts 12. The difference between shorting contacts 12 and a regular contact 11 is that the shorting contacts 12 will be mounted in such a fashion that their respective contact areas 14 are actually in contact. The balance of the contacts 11 can be made of phosphor bronze or other less expensive materials, but the shorting contacts 12 are made of beryllium copper because of its superb spring effect. All of the contacts, whether they are standard contacts 11 or shorting contacts 12, are invariably secured at their ends to a carrier strip 15 which permits the contacts when processed to have an endless string for processing through various steps of treatment.

The tail 16 of the contact normally extends from the insulator body 13 as shown in FIG. 1. Provision is made for a compliance area 18 positioned between the spade 19 and the tail 16. The purpose of the compliance area 18 is to jam-fittingly be inserted into a printed circuit board hole. The compliance section is spaced slightly from a spade 19. The purpose of the spade 19 is to engage a socket or pocket interiorly of the insulator body 13 for secure mounting in the insulator body 13. Various techniques are employed for inserting the contacts 11, 12 in the insulator body 13 and do not form a part of this invention, but do illustrate the importance of the annealing of the beryllium copper contacts 12 to eliminate the problem of breakage due to flexure of the heat treated beryllium copper.

Figure 3:
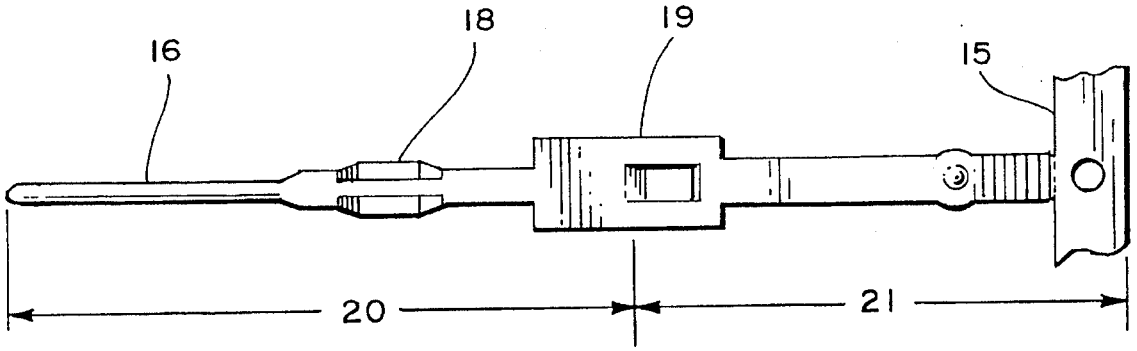
FIG. 3 is a plan view of an illustrative connector showing the annealed zones in double cross-hatching thereby revealing the tolerance of the length of the annealed zone.
Figure 4:
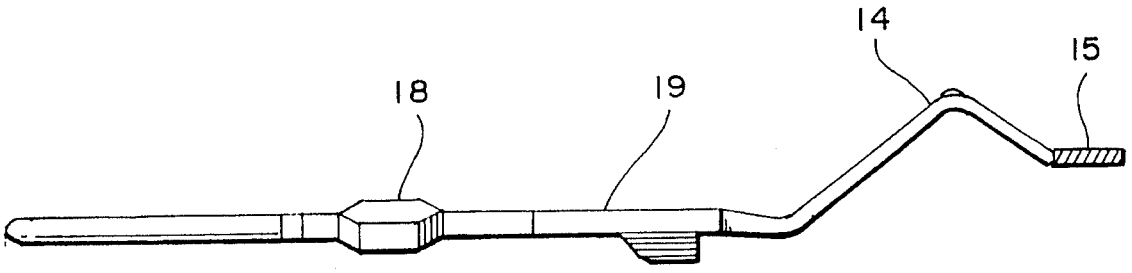
FIG. 4 is a front elevation of the subject contact.

Since the breakage normally occurs toward the tail section from the spade, there is a maximum annealing area 20 as illustrated in FIG. 3, and a minimum water covered area 21 also as illustrated in FIG. 3. The annealing area 20 can be reduced to a degree, and at the same time the water covered area 21 increased. It will be appreciated, however, that if the spade 19 is totally inserted into the insulator body 13, when bending of the tail 16 occurs, it will be towards the tail portion close to the spade 19. More particularly, when the bending occurs only after insertion into a printed circuit board and secured therein by the compliance section 18, the breakage will invariably occur between the compliance section 18 and a mid-portion of the tail 16.

As stated in the summary of the invention, a determination can be readily made as to whether the contacts 11, 12 has been properly annealed in accordance with the process. One need only grasp the contact 11, 12 somewhere between the spade 19 and the contact area 14, and then begin flexing the tail 16. When bent to an angle exceeding 45° with a non-annealed copper beryllium contact 12, it will break on the first bend. Conversely, when properly annealed in accordance with the present invention, the same flexing can be done for at least three to four times before breakage occurs.

The Annealing Cell

Figure 5:
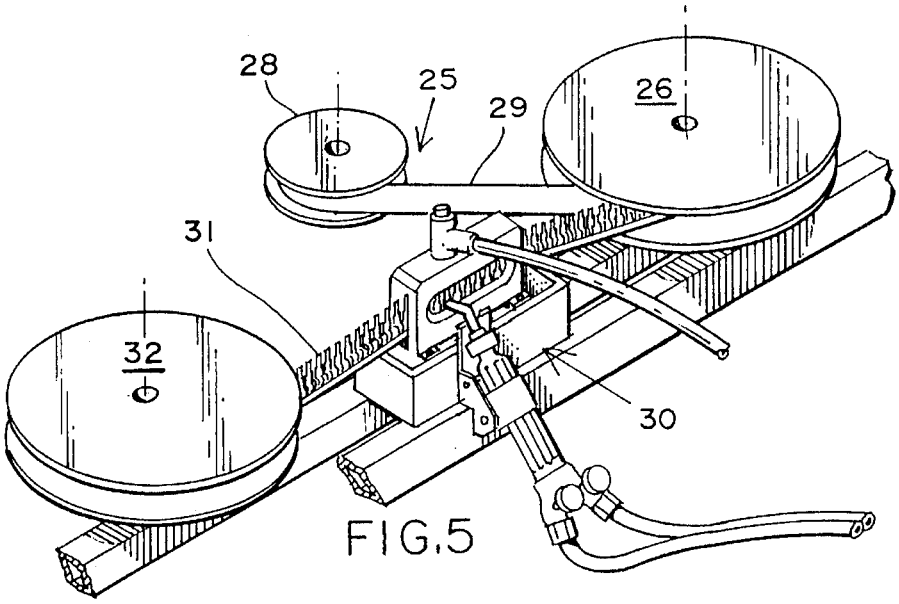
FIG. 5 is a perspective view of a reel-to-reel annealing and quenching station somewhat diagrammatically shown.

A typical annealing assembly 25 is illustrated perspectively and partially broken in FIG. 5. There it will be seen that a reel of contacts 26 includes the supply reel 28 from which the separator tape 29 is moved and coiled on a separator reel 28. The process station 30 has passing through its mid-portion a plurality of contacts, but in the form of contact strips 31 which include the contact 11, 12 and its associated carrier strip 15.

Figure 6:
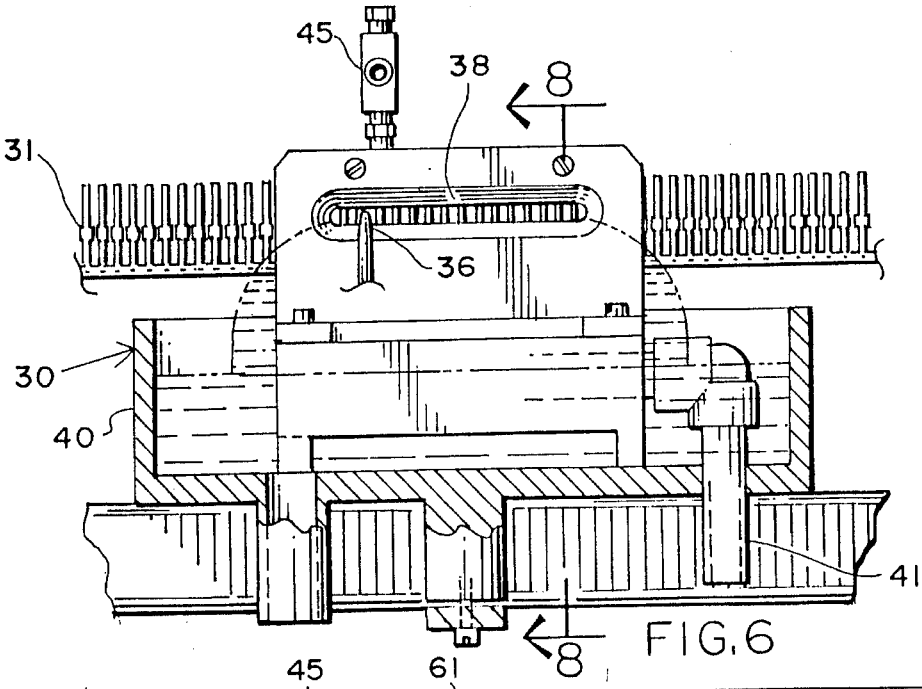
FIG. 6 is a front elevation of a commercially acceptable anneal and quenching station.
Figure 7:
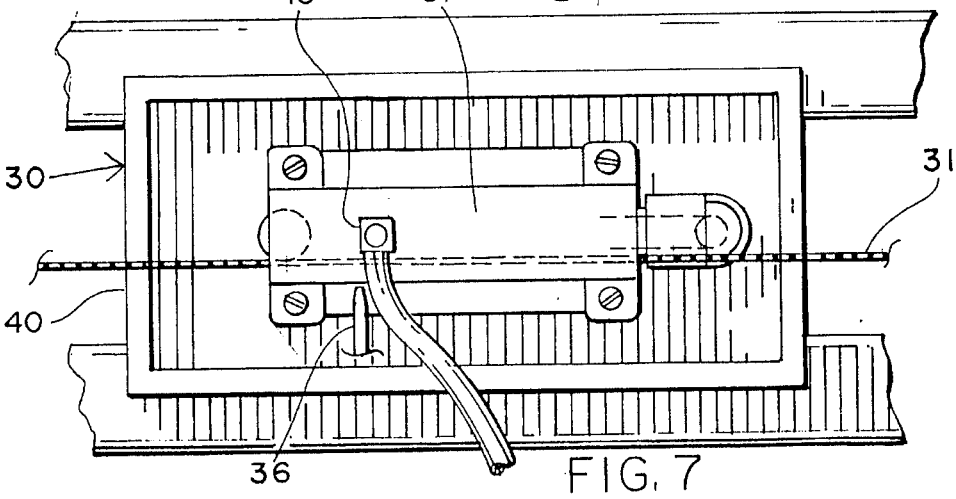
FIG. 7 is a top view of FIG. 6.

In greater detail as shown in FIG. 6 the processing station 30 has a contact strip 31 passing through it in the direction of left to right. A torch 35 having a torch tip 36 (the torch best shown in FIG. 8) is positioned at the entrance portion of the inspection slot 38. Water is constantly available for circulation in the processing station 30, with a water inlet and outlet 41, 42 in open communication with the cell 40. The top view as shown in FIG. 7 illustrates the close proximity of the torch tip 36 and the quenching water flow control 45. The connector strip 31 and its orientation are also shown in FIG. 7.

Figure 8:
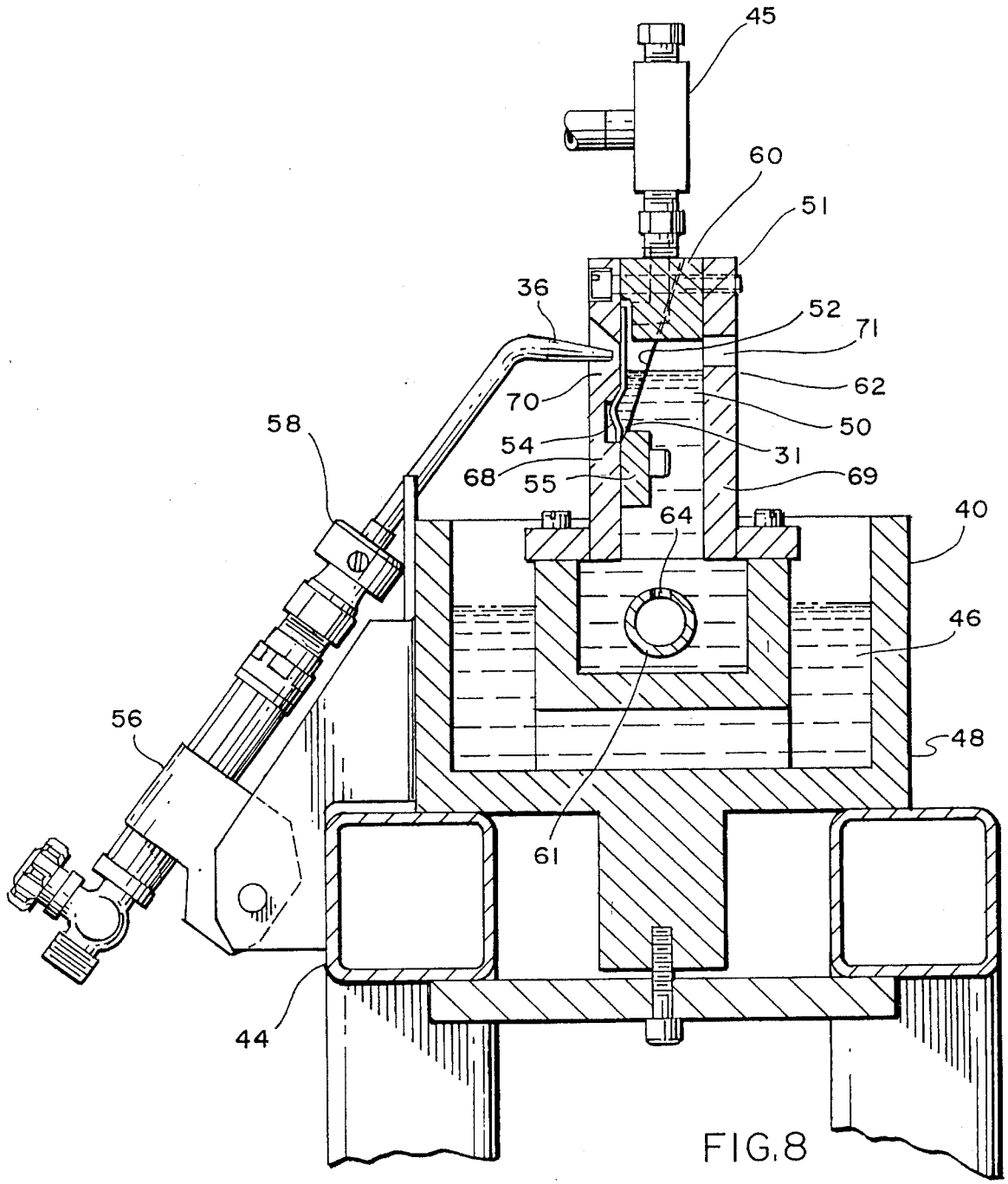
FIG. 8 is a transverse sectional view of FIG. 6 taken along section line 8—8 of FIG. 6.

For greater detail, attention is now directed to FIG. 8 which is a transverse sectional view of the entire annealing assembly 25 taken along section line 8—8 of FIG. 6. There it will be seen that the cell 40 is positioned atop a base 44 and contains discharge water 46 which, in turn, is in the discharge tank 48 portion of the cell 40.

A stationary wave of water 50 is confined in the wave cell portion 51 of the cell structure 40 and atop of the same. A water discharge barrier 52 is positioned at both ends of the wave cell 51 to provide for a lower triangular portion for a discharge opening 54 at both ends and facing the minimum water covered area 21 of the connector strip 31. The carrier strip 31 is oriented interiorly of the wave cell 51 immediately on top of the strip guide 55.

The position of the torch 35 is accomplished by a torch bracket 56 secured to the annealing assembly, and including an adjusting cam 58. What is most important is that the torch tip 36 impinge upon the inspection slot 38 to the end that heat shock may be applied to the carrier 12 in the maximum annealed area 20 while constantly there is a water bath in the minimum water covered area 21. Where the contact includes a compliance section 18, it is important that the compliance section be within the maximum annealed area 20 so that once it is heat shock treated it will behave like a softer material, and form its intended gas-tight fit with a hole in a printed circuit board. The quenching water flow control 45 is adjusted to spray water in at a spray control head 60 so that it bathes the entire tip 16 of the carrier strip 31 shortly after the same has been subjected to the thermal shock of the acetylene oxygen flame which is directed on the annealed area 20 through the torch tip 36.

To supply water to the entire annealing assembly 25 provision is made for the manifold 61 and manifold ports 64 in the central portion of the wave control fixture 62 which has front wall 65 and back wall 69 in the form of a tubular pipe having a plurality of small holes drilled longitudinally along the top. The front wall 68 has a chamfered slot opening 70 and the back wall 69 has a straight opening 71.

The Method

The method of invention in an ideal embodiment is preliminarily to provide a plurality of stamped contacts 12 formed of beryllium copper alloy 172 one-quarter each de-temper 75/78 KSI Tensile, 17% minimal elongation 0.005 mm max grain size.

The contacts are released from a carrier reel and transferred to a take-up reel. The contact should be heat treated before plating for the desired spring quality. Normally such heat treating takes place for two hours at 600° F. with a nitrogen pump, no scale, and degreased. This treatment, however, will induce brittleness.

In accordance with the invention the torch 35 and the torch tip 36 are so positioned and controlled, conforming to the speed of the travel of the contact strip 31, to the end that the maximum annealed area 20 of the contact 12 is brought to a point just short of observable oxidation. By "just short" what is meant is that a slight elevation in temperature or reduction of speed of travel of the strip 31 will cause observable oxidation, whereas a slight reduction of temperature or increase of speed of travel from the threshold of observable oxidation, will render the oxidation non-observable. Where the contact 11 has a compliance section 18 it is important that the area of annealing 20 include the entirety of the compliance section. Thereafter the contact 12, as soon as practicable, is subject to a water quenching. At all times the minimum water covered area 21 of the contact 12 is immersed in water so that even during the heat shock step to heat shock just short of developing visible oxidation, that portion of the contact is shielded from the main thrust of the heat shock. After the strip 31 is so treated it is transported onto a take-up reel 32, and subsequently processed with normal acidizing, plating, and finishing techniques.

The annealing assembly 25 can be positioned separately as shown in FIG. 5, or included on a production line which accomplishes all of the other steps necessary. For practical purposes, however, the separate station has its desirable features inasmuch as the copper beryllium annealed contact 12 illustrative of the present invention may constitute less than 10% of the total contacts used in the facility, despite the fact that the copper beryllium contacts 12 may find their way into 90% of the connectors 10 processed at the facility. This was explained above where it was pointed out that the copper beryllium contacts are significantly more expensive than the phosphor bronze contacts, but this is required since as shorting contacts they must meet in face-to-face contact in the connector 10. They therefore require additional flexing, and must be made out of beryllium copper in order to have the spring properties required. Introduced with the spring properties, however, is brittleness. It is to eliminate the brittleness in preselected areas of the contact that the heat shock treatment of the present invention is applied.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A contact for use in a connector, which contact has a tail having an end, a central body portion, and a contact curvilinear portion at the opposite end of the tail formed from beryllium copper characterized in that:

said body portion and said tail has been annealed by heat shock in an area of probable undesirable bending for a dwell time and temperature sufficient to render the beryllium copper flexible and yet not to cause observable oxidation, said characteristic being measurable by repeated bending at a 90° angle with a first two bends not inducing fracture as contrasted with an identical contact which has not been annealed by heat shock.

2. A contact of claim 1, in which said contact has a compliance section and in which the area of probable undesirable bending includes the compliance section.

3. A contact of a compliant pin press fit card edge variety having a tail for electrical connection either by wire wrap or solder, a central body portion, said central body portion including a compliance section and a spade section, said compliance section being closest to an end of the tail and said spade section being closest to the opposite end of the tail portion which has been curved to form a knuckle which is a contact area, said contact being formed of beryllium copper, said contact having an annealed by heat shock area which is in an area of probable undesirable bending and including the compliance section and which has been annealed by heat shock to a temperature and for a time approaching a threshold of observable oxidation, and said contact may be bent to an angle of 90° in an area of probable undesirable bending approximating the spade section without fracture for at least a first two bends as contrasted with an identical contact which has not been so annealed with heat shock.

4. The contact of claim 3 above, in which said contact has been acid treated and plated for electronic communication with another element in a circuit.

* * * * *